US007036554B2

(12) United States Patent
Nippert et al.

(10) Patent No.: US 7,036,554 B2
(45) Date of Patent: May 2, 2006

(54) METHOD AND SYSTEM FOR CASTING METAL AND METAL ALLOYS

(76) Inventors: Russell Nippert, 3177 Melbury Dr., Columbus, OH (US) 43221; Brian Swank, 6190 Twp. Rd. 21, Marengo, OH (US) 43334; Ilppo Hiekkanen, Rautaharkontie 15, FI-33820, Tampere (FI); Ilpo Koppinen, 166 Trotter's Cir., Delaware, OH (US) 43015

( * ) Notice: Subject to any disclaimer, the term of this patent is extended or adjusted under 35 U.S.C. 154(b) by 0 days.

(21) Appl. No.: 10/937,448

(22) Filed: Sep. 8, 2004

(65) Prior Publication Data

US 2006/0048916 A1 Mar. 9, 2006

(51) Int. Cl.
*B22D 11/04* (2006.01)

(52) U.S. Cl. ..... 164/316; 164/119; 164/337; 164/133; 164/55.1; 164/57.1

(58) Field of Classification Search ..... 164/316, 164/119, 337, 133, 55.1, 57.1, 443, 485
See application file for complete search history.

(56) References Cited

U.S. PATENT DOCUMENTS 2,553,921 A 5/1951 Jordon ..... 22/57.2
5,062,614 A * 11/1991 Sukekawa et al. ..... 266/216
5,381,853 A * 1/1995 Koivisto et al. ..... 164/443
6,500,228 B1 * 12/2002 Klingensmith et al. ..... 75/386
6,503,292 B1 * 1/2003 Klingensmith et al. ..... 75/386
6,742,568 B1 * 6/2004 Meyer ..... 164/119

FOREIGN PATENT DOCUMENTS

WO WO 02/20194 3/2002

* cited by examiner

*Primary Examiner*—Kevin Kerns
*Assistant Examiner*—I.-H. Lin
(74) *Attorney, Agent, or Firm*—Morgan & Finnegan, L.L.P.; Bartholomew Verdirame; Michael A. Willis

(57) ABSTRACT

The invention is relating to a system for casting metal, the system comprising a holding furnace (3) containing a base metal melt (2), at least one casting crucible (1) mounted inside the holding furnace (3) and situated at least partly in the base metal melt (2), the said casting crucible (1) divided to at least first volume (4) and second volume (5) with a separating wall (6), which separating wall (6) is forming a gap (10) with the casting crucible wall (11) said casting crucible (1) having at least one opening (12) in the wall (11) from the first volume (4) to the base metal melt (2) in holding furnace (3) and having means to import alloying material (7) to the first volume (4) and having at least one casting die (8) in the second volume (5) inserted into the alloyed metal melt (9). The invention also relates to a method of casting metal.

12 Claims, 1 Drawing Sheet

METHOD AND SYSTEM FOR CASTING METAL AND METAL ALLOYS

FIELD OF THE INVENTION

This invention relates to method and system for casting metal and metal alloys.

BACKGROUND OF THE INVENTION

Casting of metal and metal alloys is typically completed by melting metal cathode or scrap and then alloying the metal to desired chemistry. The primary method for producing metal alloys is to melt the base metal in a melt furnace and then either alloy the metal in the melt furnace or transfer the metal to a holding/casting furnace and alloy the metal at that point.

Continuous casting of metals can be done either through the bottom of the melt container, through the wall of the melt container (horizontal casting) or using upward casting process. Documents relating to the upward casting process are for example U.S. Pat. No. 2,553,921 and WO 02/20194 A1.

In upward casting process the profiled metal products are continuously cast by maintaining a water-cooled metal nozzle immersed into a melt to receive and cool the melt. The nozzle is immersed so deep into the melt that the point of solidification of the received melt is below the surface level of the outside melt and the solidified melt is then pulled upwards while being further cooled.

The problems with the above-mentioned casting processes are that it is not economically possible to cast small volumes of alloyed metal. Also for the casting that involves for example copper alloys (CuCr, CuZr, CuTi, etc.) that have a high affinity for oxygen and carbon are not possible to continuously cast in a production environment.

SUMMARY OF THE INVENTION

The object of the invention is to introduce a new method and system for casting metals and metal alloys. According to the invention a casting crucible, which is divided into two areas with separating wall, is placed to the basic metal melt hold in a melting/holding furnace. The casting crucible is having weep holes for the base metal melt to enter to the first area of casting crucible from the melting/holding furnace. The alloying is done dynamically in the first area and the casting from the second area of the casting crucible. The alloyed metal is flowing to the casting area through a gap between the bottom of the crucible and the separating wall. This method and system enables to cast the base metal from the melting/holding furnace while at the same time casting a second more highly alloyed material from the casting crucible. This is achieved by a method and system described later in more details. In further embodiments of the invention the casting crucible is covered in such manner to exclude oxygen and maintain suitable casting environment in the crucible.

By placing a separate casting crucible to the melting/holding furnace it is possible to have a quick change flexible casting system for casting low volumes of a variety of copper alloys that is not cost-effective when prior art casting methods are used.

The above-mentioned drawbacks of prior art casting methods and systems and presented advantages over prior art are achieved with a method and system according to the independent claims. In dependent claims are presented other advantageous embodiments of the invention.

BRIEF DESCRIPTION OF THE DRAWINGS

In the following the preferred embodiments are described in more details with reference to the accompanying drawing, where.

DETAILED DESCRIPTION OF THE PREFERRED EMBODIMENTS

Figure 1:
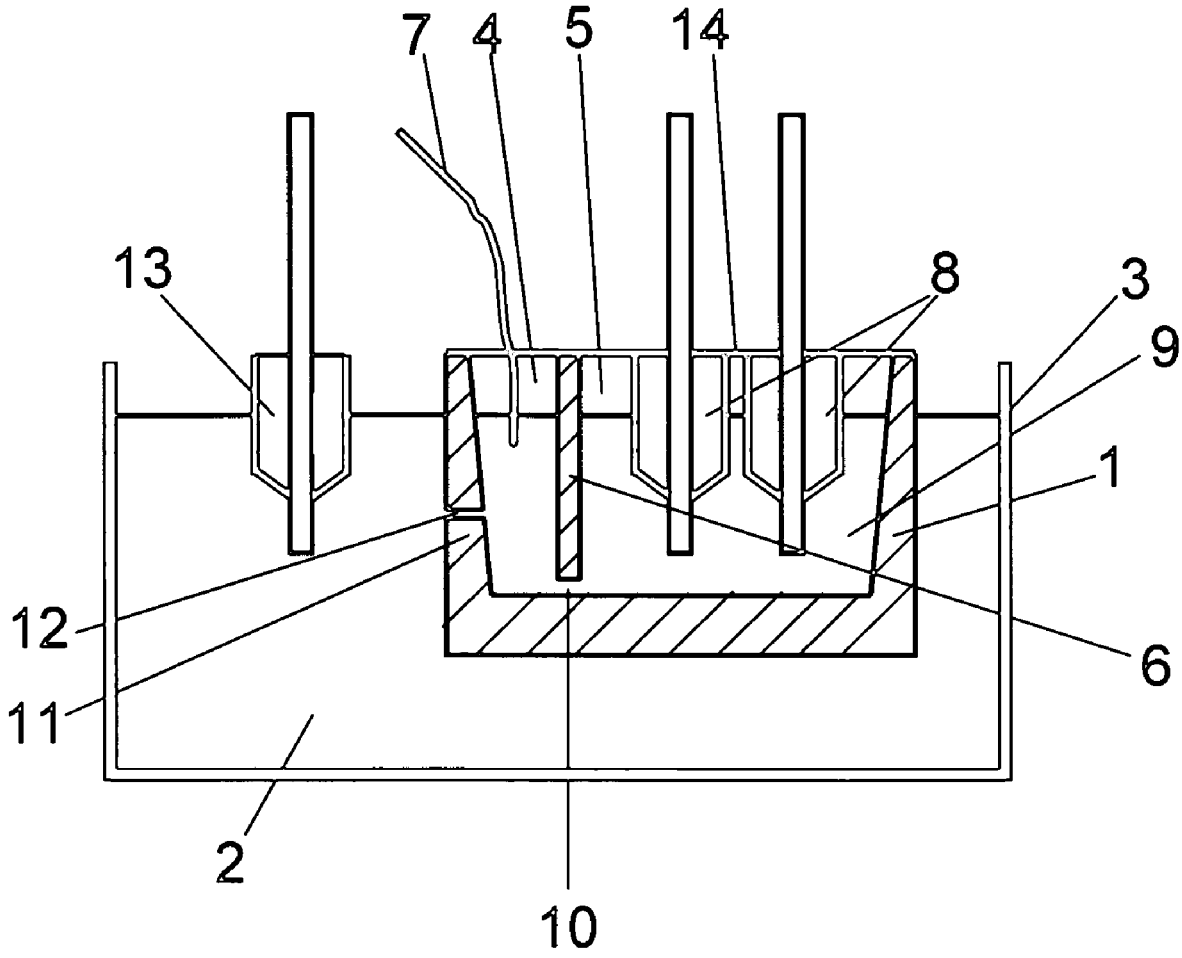
FIG. 1 is a simplified view of casting configuration.

In FIG. 1 the casting crucible 1 is placed in a base metal melt 2 in a melting/holding furnace 3. The base metal melt 2 in the holding furnace 3 could for example be copper, copper alloy or some other metal. The casting crucible 1 is divided into to two areas 4 and 5 by a separating wall 6. The first area 4 is alloying area, where the master alloy or alloys 7 are brought to the base metal melt 2. The second area 5 is the casting area, where the casting of the product is done. In the second area 5 there are two casting dies 8, immersed deep into the alloyed metal melt 9 and the solidified melt is then pulled upwards while being further cooled. The number of casting dies 8 is freely selectable. Through the gap 10 between the separating wall 6 and the wall 11 of the casting crucible 1 the alloyed metal melt 9 can flow from the first/alloying area 4 to the second/casting area 5.

The base metal melt 2 in the holding furnace 3 is surrounding at least partly the casting crucible 1 and a compensatory flow to the first/alloying area 4 of the casting crucible is arranged through feedhole or -holes 12 in the casting crucible. The feedholes 12 are situated to the wall and/or bottom of the casting crucible 1. The size and number of these feedholes 12 are depending from the material, which is cast. The feedholes 12 are specifically placed to the casting crucible 1 to maximize the base metal melt 2 movement into the first/alloying area 4 of casting crucible and to prevent the reverse diffusion of the alloyed metal melt 9 into the base metal melt. The base metal melt 2 is alloyed with master alloy or alloys 7, which are brought to the first/alloying area 4 in the form of solid wire, cored wire, granulated powder or like. The base metal melt 2 is alloyed dynamically during casting. The new method and system allows more flexibility for casting copper or copper alloys as well as a method and a system for casting copper alloys that are to date impossible to cast with a conventional prior art casting systems.

Also to the base metal melt 2 in the holding furnace 3 could be placed an additional casting die or dies 13 for casting just the base metal. This solution enables to cast the base metal melt 2 directly through casting die 13 and alloyed metal melt 9 from the second/casting area 5 of the first casting crucible 1 through casting dies 8. It is also possible to put more than one casting crucible 1 into the holding furnace 3 and feed to them various alloy or alloys 7 in order to get more than just one type of product.

For example, with the Series 100 copper alloys, pure copper may be placed into the holding furnace 3 and then a copper alloy containing any of the following alloying elements feed to the alloying area 4 of the first casting crucible 1 may be cast from the casting area 5 of the first casting crucible (Ag, Sn, Zn, P, Zr, Cr, Ti, Nb, Al, Mg, Mn, etc.). For Series 200–1000 copper alloys, the same casting principle applies. For example C22000 may be cast directly from the holding furnace 3 through casting die 13 while casting C26000 from the casting area 5 of the casting crucible 1. An advantage of this system and method is that it minimizes the volume of the second alloy being cast from the casting crucible. This allows for a more practical system and method for casting special alloys that have small sales volumes.

One of the main advantages of the method and system is also that it allows for copper alloys (CuCr, CuZr, CuTi, etc.) that have a high affinity for oxygen and carbon to be continuously cast in a production environment. The casting crucible 1 may be constructed from or coated with material that has no endothermic reaction with the alloying agent. In extreme cases to prevent oxide and carbide formations the melt surface exposed to the environment may be protected with a ceramic, glass, flux or gas cover 14.

The system is comprising the main metal melt 2 inside the holding furnace 3 with the addition of the casting crucible 1. The casting crucible 1 is mounted in the holding furnace 3 and copper is allowed to flow from the holding furnace and to the casting crucible by weep holes 12 located at given locations around the crucible (alloying area 4). The weep hole 12 size and location are designed to minimize the potential of copper from the casting crucible 1 flowing back into the base metal melt 2 and to minimize the alloyed metal melt 9 movement inside the casting crucible 1 during casting.

The casting crucible 1 can be composed of typical refractory (Al2O3, SiC, etc.) or other material (graphite, clay-graphite, etc.) The energy required for maintaining the metal molten inside the casting crucible 1 may originate from conduction from the base metal melt 2 surrounding the casting crucible or if needed by specially placed heating elements within the casting crucible. Once the base metal melt 2 has been allowed to fill the casting crucible 1 the casting dies 8 and coolers are inserted into the alloyed metal melt 9 located within the casting crucible (casting area 5). After the casting process has been established the base metal melt 2 located within the casting crucible 1 (alloying area 4) may be dynamically alloyed during casting. Since the basic metal melt 2 is being extracted from the holding furnace 3 at the given rate, the rate of alloy 7 addition must be coordinated with the material volume being cast out of the casting crucible 1. Therefore the rate of added alloy 7 is a function of the extraction rate minus any environmental losses. The melt located within the casting crucible 1 may be alloyed prior to casting, but the risk of contamination from the alloyed metal melt 9 from the crucible to the holding furnace 3 will exist.

It is possible to arrange several casting crucibles 1 side by side inside the holding furnace 3 for casting several different alloys at the same time by adding different alloys to every casting crucible. Another possibility is to arrange the casting crucibles 1 in series so that the first casting crucible is holding inside a second casting crucible in its casting area 5 and the second casting crucible is holding inside a third casting crucible in its casting area and so on. Every casting crucible 1 is having an alloying area 4, where the melt is dynamically alloyed. It is also possible to make an embodiment with a combination of these presented solutions.

While the invention has been described with reference to its preferred embodiments, it is to be understood that modifications and variations will occur to those skilled in the art. Such modifications and variations are intended to fall within the scope of the appended claims.

The invention claimed is:

1. A system for casting metal, the system comprising a holding furnace containing a base metal melt, at least one casting crucible mounted inside the holding furnace and situated at least partly in the base metal melt, the said casting crucible divided to at least first volume and second volume with a separating wall, which separating wall is forming a gap with the casting crucible wall said casting crucible having at least one opening in the wall from the first volume to the base metal melt in the holding furnace and having means to import alloying material to the first volume and having at least one casting die in the second volume inserted into the alloyed metal melt.

2. A system according to claim 1, further comprising at least one casting die in the holding furnace.

3. A system according to claim 2, where the casting crucible is further comprising a cover.

4. A system according to claim 3, where the casting crucible is heated with additional heating elements.

5. A system according to claim 4, comprising a plurality of casting crucibles assembled side by side inside the holding furnace.

6. A system according to claim 4, comprising a plurality of casting crucibles assembled in series inside the holding furnace.

7. A system according to claim 4, comprising a plurality of casting crucibles assembled side by side and in series inside the holding furnace.

8. A method of casting metal, where a base metal melt is held in a holding furnace comprising the steps of:

mounting a casting crucible into the holding furnace;

extracting the base metal melt through at least one opening in a casting crucible wall into a casting crucibles first volume;

alloying dynamically the base metal melt with at least one alloy in the first volume to get alloyed metal melt;

flowing the alloyed metal melt from the first volume to the second volume of the casting crucible through a gap between the separating wall and casting crucible wall; and casting the alloyed metal melt from the second volume with at least one casting die.

9. A method according to claim 8, the method further comprising at least one of the following steps:

casting also the base metal melt directly from the holding furnace with at least one casting die;

heating the casting crucible with additional heating elements;

covering the casting crucible with a cover to maintain production environment; and sizing the openings at the casting crucibles wall and the gap so that the flow of the alloyed metal melt back to the holding furnace is minimized and the alloyed metal melt movement in the second volume of the casting crucible is minimized.

10. A method according to claim 8, the method further comprising mounting two or more casting crucibles side by side inside the holding furnace and dynamically alloying the base metal melt with different alloys in separate casting crucibles.

11. A method according to claim 8, the method further comprising mounting two or more casting crucibles in series inside the holding furnace and dynamically alloying the melt in every casting crucible.

12. A method according to claim 8, the method further comprising mounting two or more casting crucibles side by side and in series inside the holding furnace and dynamically alloying the melt in every casting crucible.

* * * * *